United States Patent [19]

Dunsworth

[11] Patent Number: 4,800,701

[45] Date of Patent: Jan. 31, 1989

[54] PORTABLE MOTORCYCLE GARAGE

[76] Inventor: Ewell E. Dunsworth, R-1 Box 233-A, Augusta, Kans. 67010

[21] Appl. No.: 79,416

[22] Filed: Jul. 30, 1987

[51] Int. Cl.[4] ..... E04B 1/343

[52] U.S. Cl. ..... 52/66; 52/67; 52/71; 52/143

[58] Field of Search ..... 52/143, DIG. 14, 66, 52/67, 71; 150/52 K, 52 R

[56] References Cited

U.S. PATENT DOCUMENTS

| | | | |
|---|---|---|---|
| 3,465,765 | 9/1969 | Dietz | 52/67 |
| 3,600,866 | 8/1971 | Griffith | 52/143 |
| 3,786,951 | 1/1974 | Ruff et al. | 52/143 |
| 4,306,390 | 12/1981 | Brown | 52/67 |

FOREIGN PATENT DOCUMENTS

| | | | |
|---|---|---|---|
| 2453245 | 12/1980 | France | 52/67 |

*Primary Examiner*—Michael Safavi
*Attorney, Agent, or Firm*—Leon Gilden

[57] ABSTRACT

A portable motorcycle garage is provided with a forward portion pivotal about a rear portion enabling entry into said garage. A storage compartment is positioned within said forward pivotal portion accessible for storage of paraphernalia associated with use of a motorcycle when said rear section is pivoted upwardly. A trailer hitch and wheels are selectively securable to said garage for transport of said garage. Pivotal loading feet are positioned proximate said securable wheels to ease in attachment of said wheels to said portable motorcycle garage by spacing said wheels above ground level.

9 Claims, 1 Drawing Sheet

12
W
10
11
19
21
21
H
L
13
11a
15
15
14
23
20
30
12a
22
31
13
14
12a
17
18
28
16

20
21
19

12b
11b
19
15
30
30
31
27
29
12a
13
14
22
12a 26
13
23
25
31
13
14
14
28
22
27
24

PORTABLE MOTORCYCLE GARAGE

BACKGROUND OF THE INVENTION

Field of the Invention

The present invention relates to portable garages and more particularly pertains to a new and improved portable motorcycle garage which may be pivotally opened for entry of vehicles therein and converted with attachable wheels and hitch member for mobility thereof.

Description of the Prior Art

The use of portable garages is well known in the prior art. To be appreciated, these devices have required a substantial amount of space and have normally been awkward and of dimensions resisting mobility. In this connection, there have been several attempts to develop portable garages which may be easy and efficiently utilized and relocated.

U.S. Pat. No. 2,679,254 to Green sets forth the concept of a permanent structure utilizing an overlying boom to support a shroud-like portion that may be applied and retracted from about the upper surface of an automobile. The Green reference provides no means of transport of this garage-like organization and furthermore security of the shrouded automobile is not provided. While a functional solution for storage during periods of user inactivity, the Green garage is not particularly adapted for easy transport where user thereof could easily transport my invention from one location to another.

Another example of a portable garage is set forth in U.S. Pat. No. 3,056,415 to Nimmo teaching the use of a collapsible tent structure utilizing a skeletonized frame work about which a tent-like member is secured. The Nimmo garage allows for collapsibility of the garage and transport thereof from one location to another but is not utilizable as a trailering means or a secure means for storage of vehicles therein.

Other examples of flexible, overlying structures for use with motor vehicles are set forth in U.S. Pat. No. 3,785,697 to Dabbs, U.S. Pat. No. 4,305,415 to Galli, U.S. Pat. No. 4,519,644 to Song. These examples typify use of flexible overlying structures with the inherent limitations of providing limited protection and safety of the vehicle and no provision of transporting the vehicle by means of the shelter itself. The problem therefore of transporting the vehicle to a new location is not addressed by these patents.

U.S. Pat. No. 3,277,621 to Merdich and U.S. Pat. No. 3,438,158 to Kane set forth the teaching of rigid automotive protective garage-like members or shelters. These shelters, however, are merely a providing of a rigid shelter in lieu of a flexible one, as evidenced by prior art structures noted above and do not address the problem of transportability of the vehicle itself.

Other countries have recognized and addressed the same problem with solutions illustrated in Russian patent No. 647,151, British patent No. 803,220, Norwegian patent No. 95,616 and German patent No. 698,153. These patents essentially are a cross-section of the U.S. approaches that have heretofore failed to fully address the problems of transportability, safety, and ease of use of portable garages as are becoming more necessary in our mobile society.

As such, it can be appreciated that there is a continuing need for a new and improved portable garage, and particularly a portable motorcycle garage, which addresses both the problems of storage, portability and safety, and in this respect, the present invention substantially fulfills this need.

SUMMARY OF THE INVENTION

In view of the foregoing disadvantages inherent in the known types of portable garages now present in the prior art, the present invention provides and improved portable motorcycle garage. As such, the general purpose of the present invention, which will be described subsequently in greater detail, is to provide a new and improved portable motorcycle garage which has all the advantages of the prior art portable motorcycle garages and none of the disadvantages.

To attain this, the present invention sets forth a portable motorcycle garage with a rear stationary section and a forward pivotal section configured and arranged such that the forward section may pivot upwardly about the rear section enabling entry of a motorcycle therein. Positioned at a distal portion of the motorcycle garage are upright support stands for secure positioning of a motorcycle within my garage. When the forward section is pivoted open for entry thereof, a cabinet-like structure pivots into proximate positioning of a rider of a motorcycle enabling securement of paraphernalia into the cabinet structure, such as helmets, goggles, gloves, etc. The forward section, when pivoted closed may be locked in place for securement of the motorcycle and belongings therein. The portable motorcycle garage has an attachable trailer hitch and wheels for enabling mobility and transportability of the apparatus from one location to another. Pivotal feet member are positioned and arranged to raise the rear level of the portable motorcycle garage to enable positioning of the wheel thereon to facilitate movement and transport of the apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable motorcycle garage which has all the advantages of the prior art portable motorcycle garage and none of the disadvantages.

It is another object of the present invention to provide a new and improved portable motorcycle garage which may be easily and efficiently manufactured and marketed.

It is a further object of the present invention to provide a new and improved portable motorcycle garage which is of a durable and reliable construction.

An even further object of the present invention is to provide a new and improved portable motorcycle garage which is susceptible of a low cost of manufacture with regard to both materials and labor, and which accordingly is then susceptible of low prices of sale to the consuming public, thereby making such portable motorcycle garages economically available to the buying public.

Still yet another object of the present invention is to provide a new and improved portable motorcycle garage which provides in the apparatuses and methods of the prior art some of the advantages thereof, while simultaneously overcoming some of the disadvantages normally associated therewith.

Still another object of the present invention is to provide a new and improved portable motorcycle garage with a rear stationary section and a forward pivotal section pivotal about the rear section.

Yet another object of the present invention is to provide a new and improved portable motorcycle garage with a forward section and a cabinet-like structure secured to a distal portion of the forward section proximate its base enabling securement of motorcycle paraphernalia therein.

Even still another object of the present invention is to provide a new and improved portable motorcycle garage with pivotal feet members enabling raising of the floor of the apparatus enabling attachment of wheels thereon to facilitate mobility of the portable motorcycle garage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
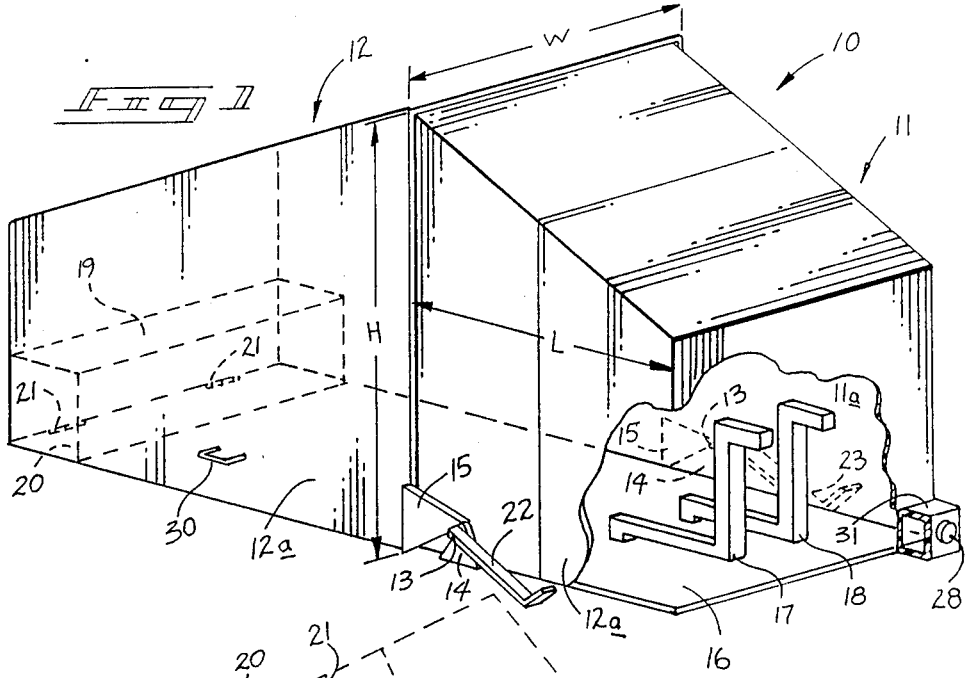
FIG. 1 is an isometric view of the present invention partially cut away in section illustrating the various portions of the apparatus, their configuration and relationship.

With reference now to the drawings, and in particular to FIG. 1 thereof, a new and improved portable motorcycle garage embodying the principles and concepts of the present invention and generally designated by the reference numeral 10 will be described.

More specifically, it will be noted that the portable motorcycle garage apparatus 10 essentially comprises a rear stationary portion 11 and a forward pivotal portion 12. The forward portion 12 is pivotal about rear portion 11 by means of plural pivot hinges 13 to a lowermost portion of either side 12*a* of forward portion 12. A stationary support 14 is secured to floor 16 of the motorcycle garage where a pivotal segment 15 is secured to forward portion of 12*a* along a vertical edge thereof as illustrated in FIG. 1. It should be noted that the height H of the sloping roof of pivotal portion 12 to terminus 12*b* relative to floor 16 is somewhat greater than the height to terminus 11*b* of the sloping roof of stationary portion 11 enabling portion 12 to pivot over portion 11. Height H is furthermore of a greater linear dimension than length L of rear portion 11 for the same purpose. Accordingly width W of portion 12 will be somewhat greater in lineal dimension than the confronting width of the stationary portion 11.

Generally, "S" shaped members 17 and 18 are positioned at a rearwardmost portion of rear stationary portion 11, as illustrated, a spaced distance from one another for positioning of a forward motorcycle wheel therebetween enabling securement thereto by conventional latching means such as chains, etc. (not illustrated).

A cabinet member 19 is formed to forward portion 12 at a lowermost corner thereof with a door 20 biased in a normally closed position by means of a plurality of spring closure hinges 21.

Figure 3:
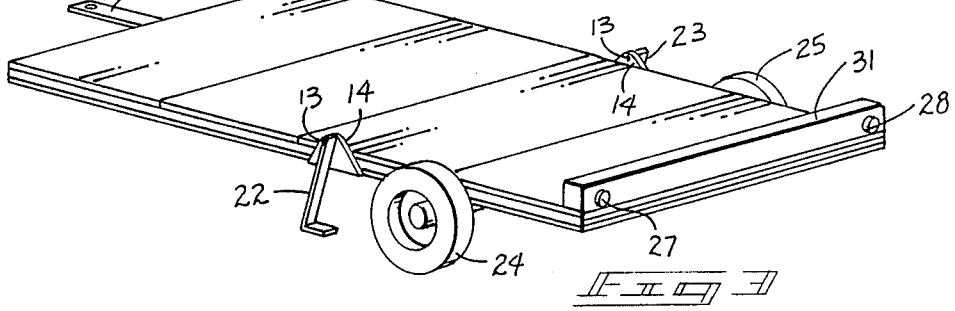
FIG. 3 is an isometric view of the present invention illustrating the pivotal feet portions in a lowered position enabling attachment of the transport wheels to the apparatus.

Reference to FIG. 3 illustrates the use of pivotal feet elements 22, 23 that are pivotal downwardly to enable spacing rear portion 11 a distance enabling attachment of wheels 24 and 25 and an associated axle to the apparatus by use of conventional fastening means. FIG. 3 further illustrates a hitch member 26 attachable enabling transport of the motorcycle garage from location to another and accordingly, the motorcycle garage would be wired in a conventional manner for use for legal over-the-road travel with the attachment thereto and wiring for use of conventional 12 volt systems of tail light members 27 and 28.

Figure 2:
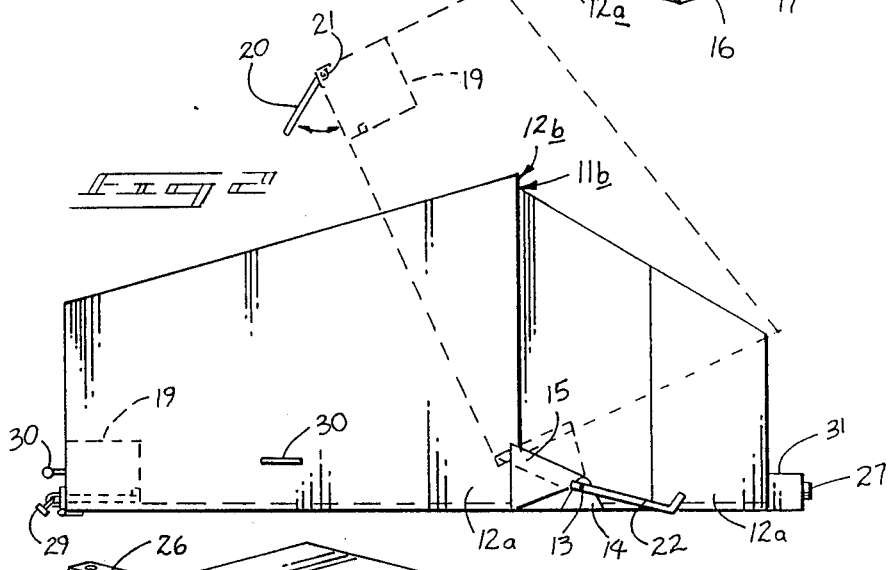
FIG. 2 is a side orthographic view of the present invention illustrating in phantom the forward section pivoted relative to the rear section.

FIG. 2 further illustrates the use of a lock assembly 29 whereupon a tang secured to floor 16 and the mating tang secured to forward portion 12 provides aligned openings therethrough for positioning of a lock of conventional manufacture to secure, in a safe and desirable manner, the contents of the motorcycle garage. Furthermore, it should be noted that a plurality of handles positioned about the sides of forward portion 12 indicated as elements 30 are arranged to enable ready manual grasping thereof to enable pivotal motion of forward portion 12 relative to stationary rear portion 11. Of further note in FIG. 2 is the configuration of abutment surface 31 positioned and arranged to halt movement of forward portion 12.

As to the manner of usage and operation of the present invention, the same should be apparent in both the description and illustrations. When use of the motorcycle garage is desired, a user will merely grasp a handle 30 and pivot forward portion 12 relative to stationary rear portion 11 by means of hinge 13 and associate stationary member 14 and movable element 15. The motorcycle garage is so configured as the motorcycle will be positioned medially and centrally of the enclosure and by grasping pivotal door 20, access to cabinet 19 is available for insertion of various items associated with the use of a motorcycle. When the motorcycle is secured to "S" shaped members 17 and 18, forward portion 12 may be returned to its initial position and secured by means of the locking arrangement 29.

Should transport of the motorcycle garage be desired, hitch member 26 will be attached to the garage by use of conventional fastening arrangements and feet 22 and 23 pivotally attached to pivot hinges 13 and securable by conventional latch or detent means (not shown) in an initial position will be pivoted downwardly to lift the garage enabling attachment of wheels 24 and 25. Thereafter the garage may be transported as desired upon repositioning feet 22 and 23 to their initial position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, accordingly, all suitable modifications and equivalents may be resorted to, falling within the scope of the invention.

What is claimed as being new and desired to be protected by Letter Patent of the United States is as follows:

1. A portable motorcycle garage transportable from one location to another comprising:

a rigid planar base portion including a perimeter, and a stationary rear portion including three vertical wall portions securing a sloping roof wherein sides are positioned about a partial perimeter of said base portion, and a forward pivotal portion formed with three vertical wall surfaces supporting a sloped roof wherein said wall portions of said forward portion are formed about a remaining perimeter of said base portion, and pivot means secured to said base portion and said forward portion positioned and arranged to enable said forward portion to pivot relative to said stationary portion to enable access to an interior of said portable motorcycle garage, and wherein said forward portion has attached thereto a cabinet means for storage.

2. A portable motorcycle garage as set forth in claim 1 wherein said cabinet means includes a pivotal lid resiliently biased in a normally closed position relative to said cabinet means.

3. A portable motorcycle garage as set forth in claim 1 wherein a plurality of generally "S" shaped members are positioned in said rear portion proximate an end thereof for support of a motorcycle therebetween.

4. A portable motorcycle garage as set forth in claim 1 wherein a plurality of wheels and associated axle are selectively attachable to said portable motorcycle garage enabling transport thereof.

5. A portable motorcycle garage as set forth in claim 1 wherein pivotal feet members are pivotal from a generally horizontal position to a generally vertically position and are of a length greater than the diameter of wheel members selectively attachable to said portable motorcycle garage; said feet members when pivoted in said vertical position space the portable motorcycle garage above a support surface enabling attachment of said wheel members thereto.

6. A portable motorcycle garage as set forth in claim 1 wherein a lock assembly selectively locks said forward portion to said base portion.

7. A portable motorcycle garage as set forth in claim 1 wherein indicator lights are secured to a vertical wall of said rear portion.

8. A portable motorcycle garage as set forth in claim 1 wherein a trailer hitch means is selectively securable to said base portion for transport of said portable motorcycle garage.

9. A portable motorcycle garage as set forth in claim 1 wherein predetermined length of said rear portion is of a lesser lineal dimension than a predetermined maximum height of said forward portion to enable said forward portion to pivot over said rear portion.

* * * * *